US007338133B2

(12) United States Patent
Laffin

(10) Patent No.: US 7,338,133 B2
(45) Date of Patent: Mar. 4, 2008

(54) BODY SUPPORT CHAIR WITH IMMOVABLE MEANS FOR MAINTAINING THE LEGS

(75) Inventor: Francois Xavier Laffin, Sion (CH)

(73) Assignee: Lifestand International SA, Sion (CH)

( * ) Notice: Subject to any disclaimer, the term of this patent is extended or adjusted under 35 U.S.C. 154(b) by 0 days.

(21) Appl. No.: 10/870,427

(22) Filed: Jun. 18, 2004

(65) Prior Publication Data

US 2005/0035648 A1 Feb. 17, 2005

(30) Foreign Application Priority Data

Jun. 19, 2003 (FR) ..... 03 07413

(51) Int. Cl.
*A47C 31/00* (2006.01)

(52) U.S. Cl. ..... 297/466; 297/423.17; 297/423.28

(58) Field of Classification Search ..... 297/423.1, 297/466, 487, 488, 423.17, 423.25, 423.26, 297/423.28, 423.18, DIG. 10; 180/9.23
See application file for complete search history.

(56) References Cited

U.S. PATENT DOCUMENTS 181,575 A * 8/1876 Hayes ..... 297/362.14
1,542,508 A * 6/1925 Koenigkramer ..... 297/300.5
4,054,319 A * 10/1977 Fogg et al. ..... 297/466
4,065,180 A * 12/1977 Karay ..... 297/466
4,280,731 A * 7/1981 Pitts et al. ..... 297/487
4,390,076 A * 6/1983 Wier et al. ..... 180/11
4,506,930 A * 3/1985 Lambert ..... 297/423.11
4,623,194 A * 11/1986 Pillot ..... 297/316
4,765,684 A * 8/1988 Kvalheim et al. ..... 297/423.13
5,137,102 A 8/1992 Houston et al.
5,346,280 A 9/1994 Deumite
5,366,036 A 11/1994 Perry
6,123,392 A * 9/2000 Alfred et al. ..... 297/466
6,568,762 B2 * 5/2003 Porcheron ..... 297/466

FOREIGN PATENT DOCUMENTS

FR 2813524 3/2002

* cited by examiner

*Primary Examiner*—Joe Edell
(74) *Attorney, Agent, or Firm*—Dennison, Schultz & MacDonald

(57) ABSTRACT

The body support chair for the physically challenged and disabled comprises a frame supporting an articulated structure comprising a back, a seat, a foot rest (33) supported by two uprights and means for holding the legs, at least in part immovable. The holding means comprise:

two cross-members, each fitted on an upright (27) of the foot rest for extending into a working position (T) towards the front of the chair and provided in the front part with fastening means (80) arranged in the working position (T) at a corresponding distance from the upright (27);

and an immovable front support element for the user's two legs, fitted on the fixation means (80) of the cross-members, in such a fashion as to extend between the cross-members.

5 Claims, 4 Drawing Sheets

BODY SUPPORT CHAIR WITH IMMOVABLE MEANS FOR MAINTAINING THE LEGS

The present invention relates to chairs used by the physically challenged and invalids and includes indifferently wheelchairs, whether folding or not.

More particularly, the object of the invention proposes chairs of the type comprising an articulated structure comprising a back, a seat and a foot rest associated with a drive element making it possible to assist or to control the verticalization or lowering of the articulated structure relative to a carrier frame.

These chairs represent indisputable genuine progress, because they make it possible, in addition to indispensable mobilization, the verticalization [uprighting] of the subject, likewise indispensable, for preventing the physical degradations resulting from protractedly maintaining the sitting position.

The prior art proposes a certain number of solutions for realizing chairs comprising an articulated verticalization structure.

These different propositions have their advantages and their drawbacks but they do allow, in general, at least partially verticalizing a subject in correct fashion.

However, it has been found that such chairs can not be used by all physically challenged or invalid subjects. In fact, for certain physical challenges or disabilities, the subject does not have or no longer has sufficient muscular control for maintaining himself in a stable position against the verticalization support surface, which represents the elevated articulated structure of a chair.

In such cases, the verticalization represents a genuine hazard to the subject, who in the absence of self-control, risks falling by being brought into lateral displacement or by yielding of the legs or even by collapse of the upper body.

Now, the possibility of verticalization is important for all of the physical challenges or disabilities and may be even more so for those who do not have physical control, such as in the cases described hereinbefore.

In order to correct this problem, it has been proposed using on the one hand at the upper body, a thoracic holding belt affixed to the structure of the back of the chair and on the other hand, at the legs, a knee strap affixed to the support uprights of the foot rest and sustaining at the same time the chair user's two legs.

These types of chest and leg straps must be considered capable of responding essentially to the problem of verticalization and holding of the subject in the verticalization and lowering phases of the articulated structure in such a fashion that the body of said subject is conveniently held in complete safety.

The feedback now available relating to the utilization of such body support chairs has, however, demonstrated the necessity of improving certain of the technical means used for assuring the physical hold and, more particularly, the means of lower holding, intended to assure the blocking of sagging of the lower extremities of the subject by immobilization of the legs immediately below the knee joint.

In fact, it has been found that it is specifically at these sites that the immobilization constraints are the most concentrated and that these requirements are in relation to the frequency and the duration of verticalization but also with the height and the weight of the subject.

For relatively long verticalization processes and occurring without interim phases wherein the subject adopts, for relatively long periods, a sitting position, bruises and even sores have been found, inducing either pain or local degradations which are poorly borne by the physically challenged person especially due to the propensity of the leg strap to lock the user's knees against each other.

There is a need, therefore, to eliminate this drawback.

Thus, a patent FR 2 813 520 proposes using as a device for lower body support, two hemi-leg cradles comprised of two frames carried by articulation supports on two uprights supporting the foot rest, the two hemi-leg stockings being connected to each other by a central locking system. The use of this type of system for holding the lower body makes it possible to effectively reduce the risk of compression sores on the knees and the zones of support of the legs on the leg cradles but it does present, however, the drawback of being particularly unwieldy, especially in the sitting position of the chair, thus even when the use of the stockings is unnecessary.

Moreover, when being opened, this type of stocking fill the lateral space of the chair. In addition, such stockings or means for holding the lower body add substantial weight to the body support chair such that they are not always suitable in the case of a manually operated chair, for which the user is seeking a compromised of comfort and light weight.

Thus, it then appears necessary to have a novel type of means for holding the legs, which offers satisfying comfort and in particular providing a solution to the problem posed by the use of a simple holding strap, while not presenting the drawbacks of weight and space requirements associated with the means for holding the lower body proposed by the FR 2 813 520 patent.

In order to respond to this need, the invention relates to a body support chair for the physically challenged or disabled comprising a frame supporting an articulated structure comprising a back, a seat, a foot rest supported by two uprights and means for holding the legs, at least in part immovable.

According to the invention, this chair is characterized in that the holding means comprise:

- two cross-members, each fitted on an upright of the foot rest for extending into a working position towards the front of the chair and provided in the front part with fastening means arranged in the working position at a corresponding distance from the upright;
- and an immovable front support element for the user's two legs, fitted on the fixation means of the cross-members, in such a fashion as to extend between the cross-members.

The use of such fastening cross-members, providing fixation means situated at a distance from the uprights prevents, at the time of installation of the frontal immovable support element, whether said latter is flexible or rigid, the application of lateral stresses on the user's legs tending to approximate the one against the other of the legs, especially causing a rubbing of the user's knees.

According to one feature of the invention, in order to even better eliminate the risk of stressing the user's legs against each other, the front parts of the cross-members are, at least in the working position, each immobilized in a frontal plane relative to the corresponding upright.

According to one feature of the invention, the cross-members are not immovable and only the frontal support element is immovable. According to this embodiment, each cross-member is thus attached to the corresponding upright and in being mobile in a vertical plane between a resting position and the working position in extension towards the front of the chair and comprises, at its front end means for fastening the immovable frontal support element.

According to one feature of the invention, each cross-member has an arcuate shape, whose concavity in the resting position is oriented towards the front and which defines two arms, so-called upper and lower; the upper arm being provided at its distal or front end with means for affixing the frontal immovable support element.

The cross-members can then be connected in any suitable fashion to the corresponding uprights in order to know the movement between their resting and working positions in extension towards the front of the chair.

In a preferred but not strictly necessary fashion, to this end each cross-member has an arcuate shape, whose concavity in the resting position is oriented towards the front and which defines two arms, so-called upper and lower; the upper arm being provided at its distal end with means for affixing the frontal immovable support element.

According to one feature of the invention the front and back arms of each cross-member each comprise an opening for receiving a slug attached to the corresponding upright for holding and guiding the cross-member. The opening of the lower arm is thus preferably but not exclusively provided at its lower end with a locking recess for receiving, in the working position, the corresponding guide slug in such a fashion as to assure a blocking of the movement of the cross-member when a force is practiced towards the front on the distal end of the upper arm.

According to the invention, the frontal support element can be realized in different ways. Thus, according to one embodiment, the frontal support element comprises a rigid plate equipped in the back part with at least one support pad for the legs of the user of the chair.

According to another embodiment, the frontal support element comprises at least one strap connecting the two cross-members.

Various other features of the invention will become apparent from the description that follows done with reference to the appended drawings that illustrate different, non-limiting embodiments of a body support chair according to the invention.

FIG. 1 diagrammatically represents a perspective view of a wheelchair according to the invention.

Figure 4:
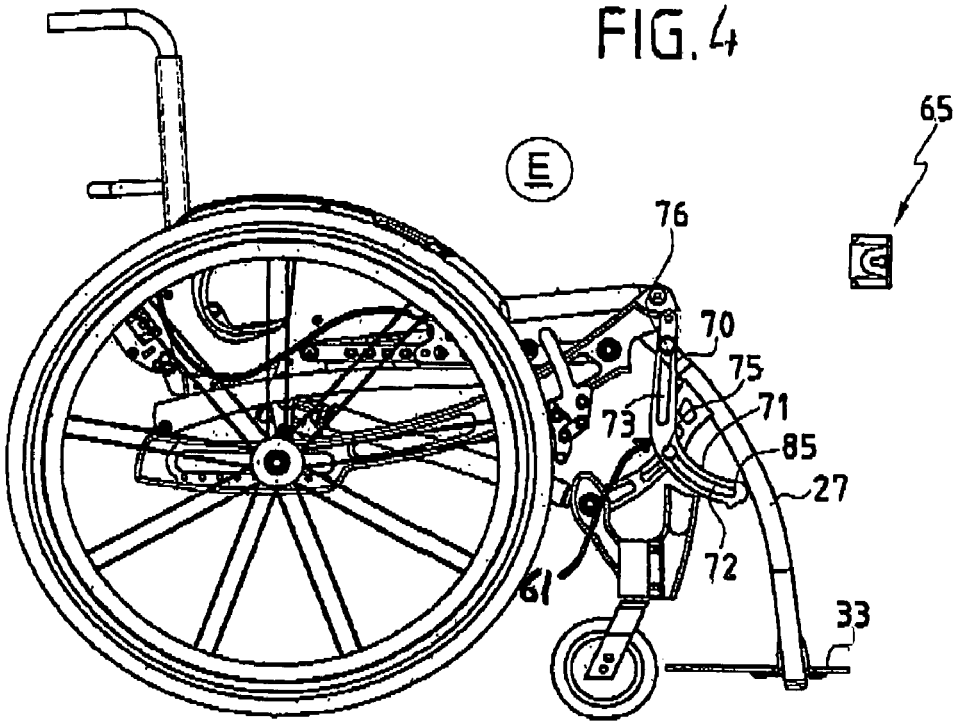
FIG. 4 represents an elevation similar to FIG. 2, sowing a preferred embodiment of the means for holding the legs according to the invention.
Figure 5:
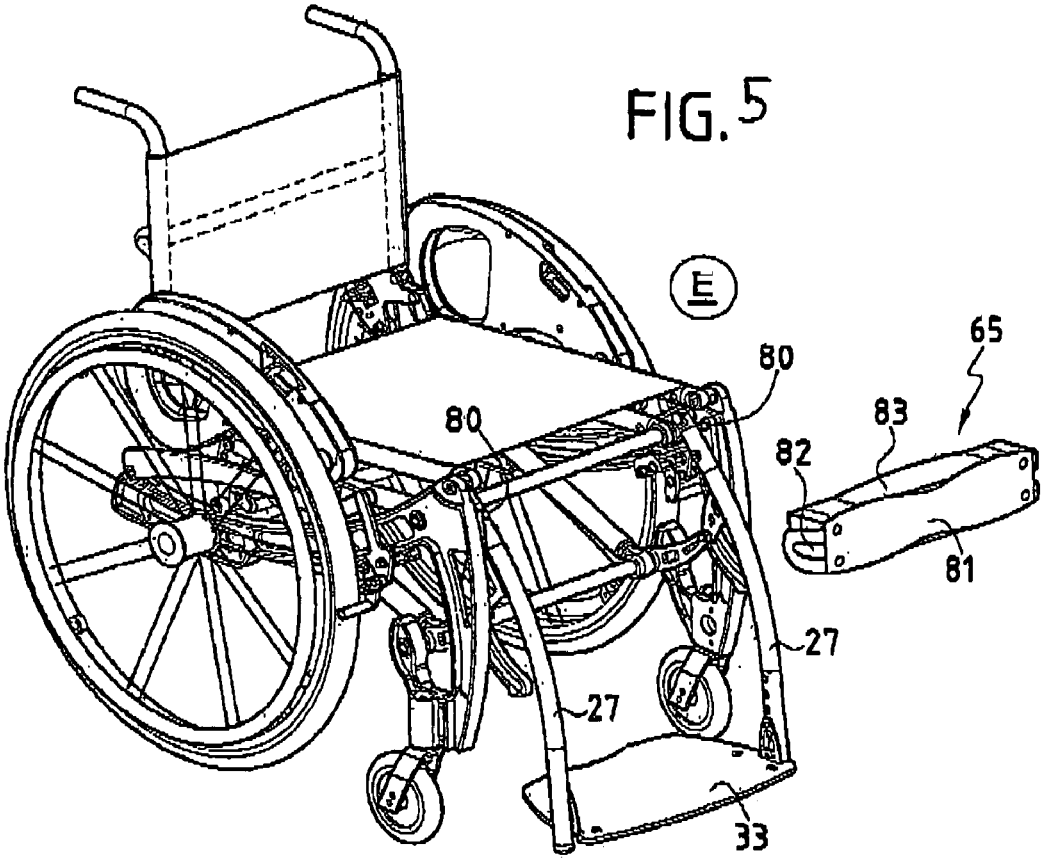
FIG. 5 represents a perspective view, similar to FIG. 1, illustrating the holding means according to FIG. 4.
Figure 6:
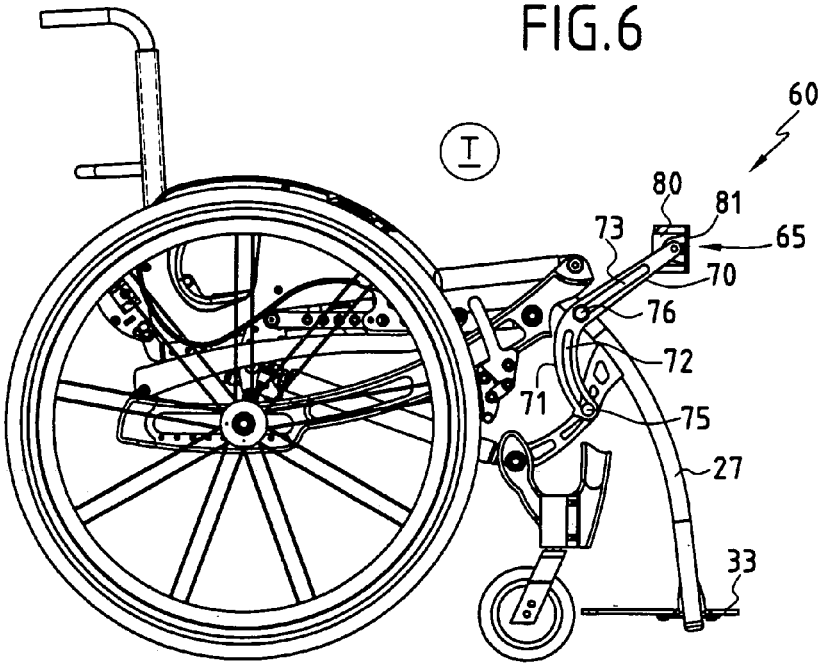
Figure 7:
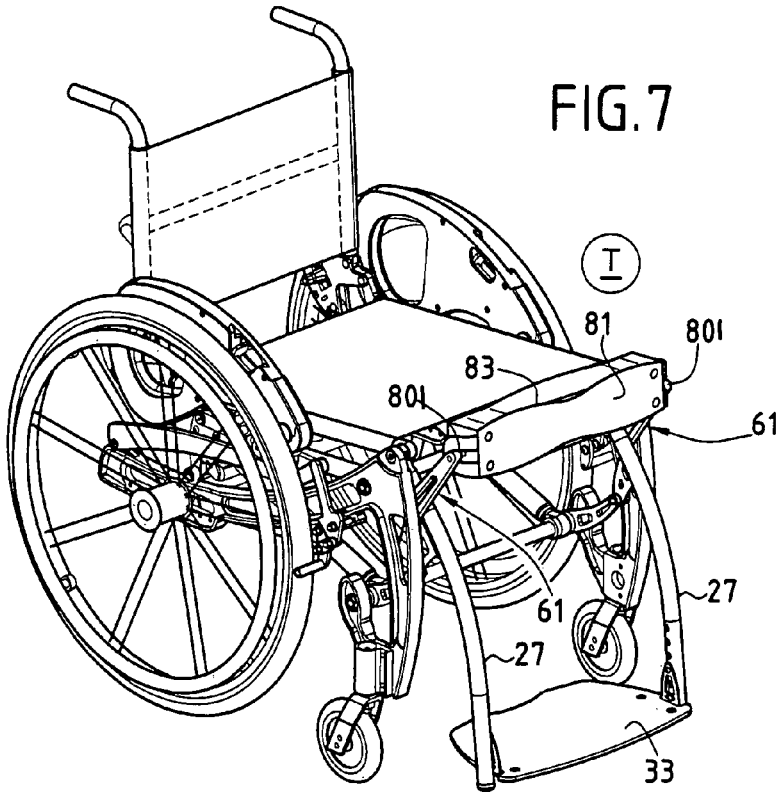

FIGS. 6 and 7 represent views, similar to FIGS. 4 and 5, respectively, showing one stage of operation of the means for holding the legs illustrated in FIGS. 4 and 5.

Figure 1:
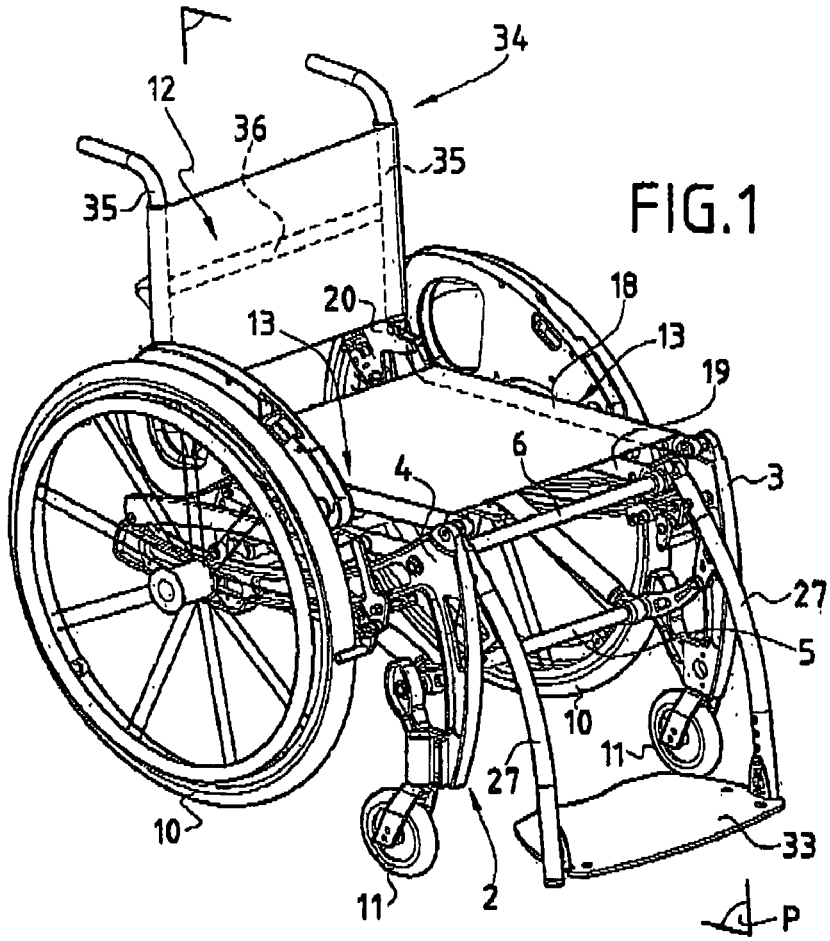
Figure 2:
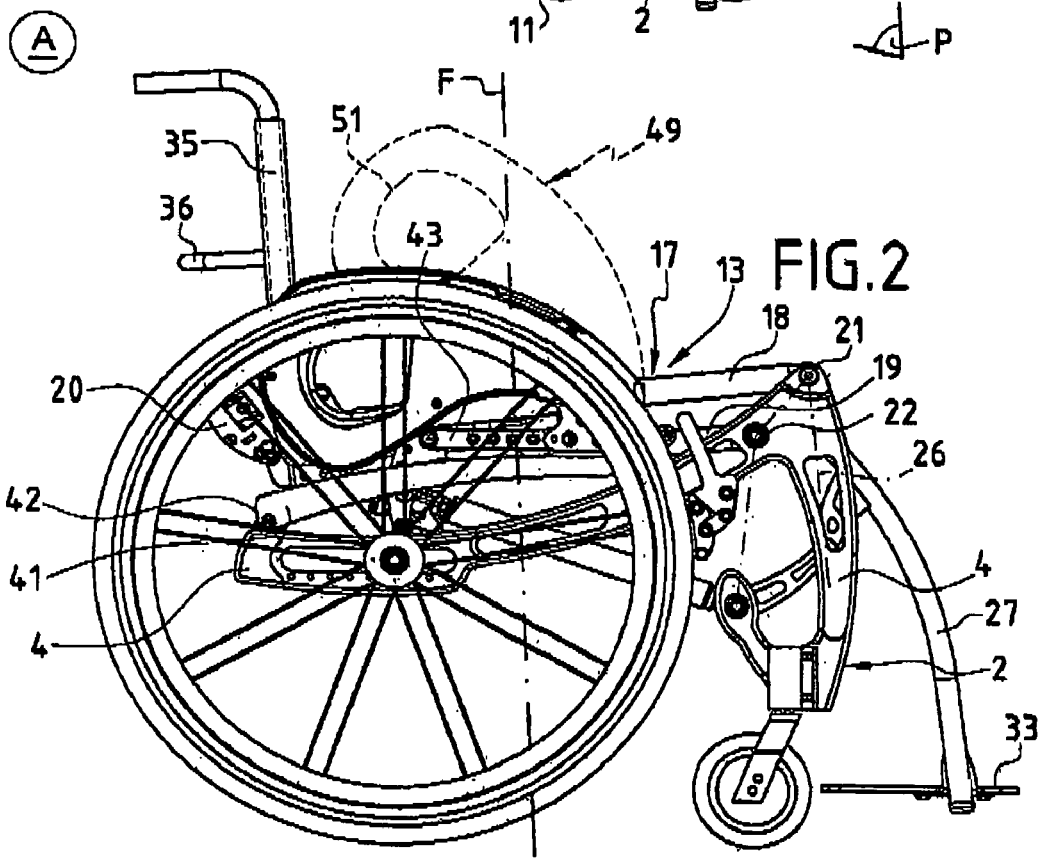
FIG. 2 represents an elevation viewed from the right of the chair according to FIG. 1.
Figure 3:
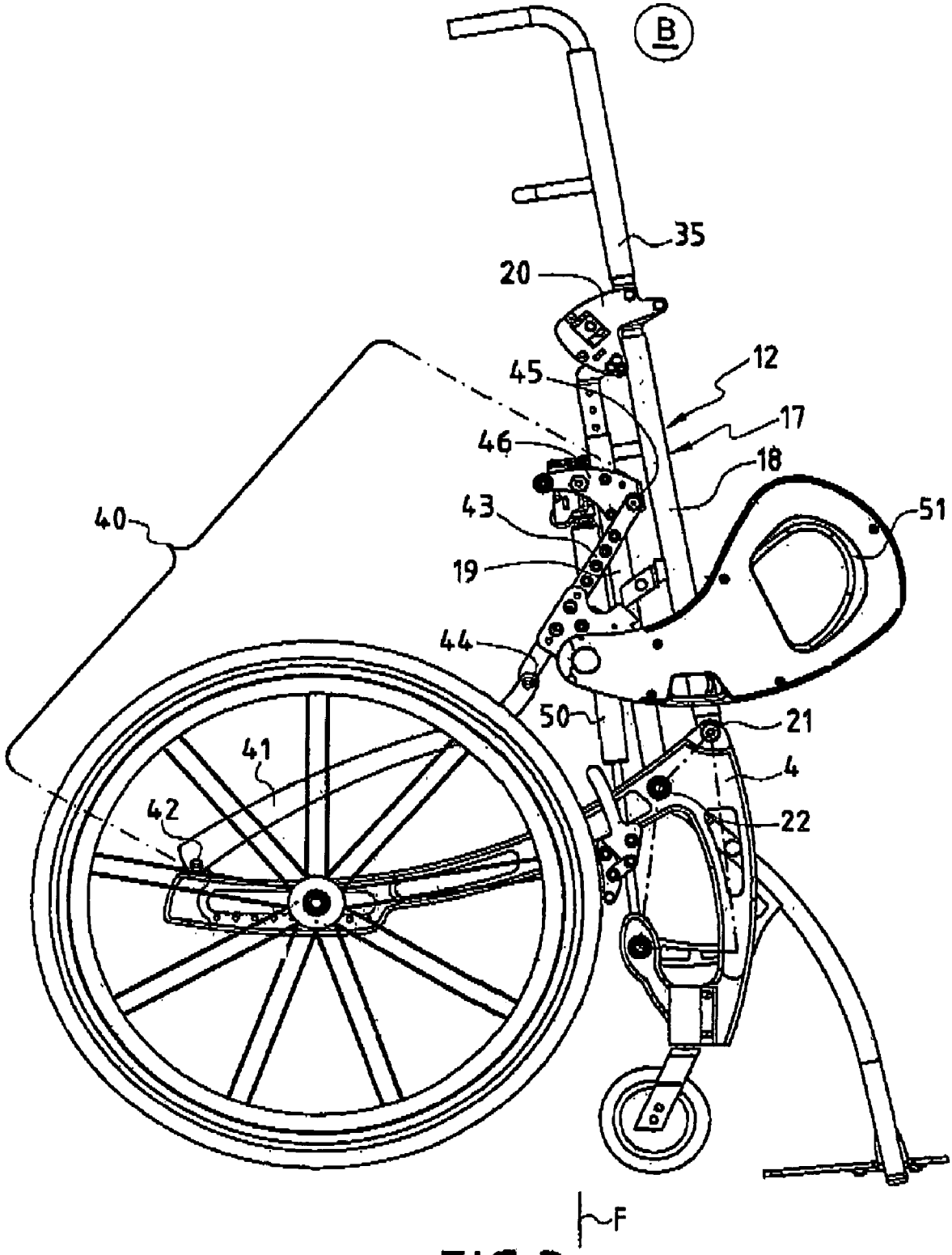
FIG. 3 represents an elevation, substantially similar to FIG. 2, of the chair in the upright position.

The invention relates to a manually propelled body support wheelchair 1 as represented in FIGS. 1 to 3, it being understood that the chair could also be equipped with a motor and electrical propulsion, for example.

This type of chair comprises a frame, comprised of lateral hemi-frames 3 and 4, connected together by cross-members 5 and 6. These different constituent elements define a supporting assembly provided with driving wheels 10 and orientable steering wheels 11.

As illustrated, the frame 2 corresponds to a rigid design chair but it is quite obvious that a substantially similar conformation could be used for a foldable chair. In fact, in such a case, the rigid cross-members 5 and 6 are then replaced by flexible elements of known design.

The frame 2 described hereinbefore is equipped with a verticalizer device, which is realized in the form of an articulated structure 12 supported by the frame 2. The articulated structure 12 is comprised by two symmetrical lateral articulated systems symmetrical relative to a sagittal plane P and which are more particularly visible in FIGS. 2 and 3. Each articulated system 13 is intended to be attached laterally to the frame 2 at each of the hemi-frames 3 and 4, for example.

Each articulated system 13 comprises a first deformable quadrilateral 17 comprised of two sills 18 and 19, respectively called top and bottom, although they are not—in the representation shown in FIG. 3—disposed in the same vertical plane. The sills 18 and 19 are connected at their rear end part by an spacer element or spacer part 20 and are mounted on the frame 2 in the vicinity of the front part of said latter by a first articulation point 21 relating to the top sill and by a second articulation point 22 relating to the bottom sill. In the present case, the point of articulation 21 is provided in the top part of the corresponding hemi-frame 3, 4 while the point of articulation 22 is situated on this same hemi-frame behind and below the point of articulation 21.

In the illustrated example, the spacer element 20 is provided for corresponding to the distance separating the points of articulation 21 and 22 such that the quadrilateral 17 has the preferred form of a deformable parallelogram, without said form being considered as necessary to the embodiment of a chair according to the invention.

Each articulated system 13 comprises in addition a second deformable quadrilateral 26, drawn in FIGS. 2 and 3 in dotted and dashed lines, connecting the first deformable quadrilateral to a jamb or similar riser 27 intended for supporting, alone or in combination with a jamb or similar riser, a foot rest 33.

Each articulated system 13 comprises a back assembly comprising two uprights 35, each of which being articulated on the first quadrilateral 13 facing the second quadrilateral 26 by means of the spacer piece 20. According to the example illustrated, the uprights 35 of the back are in addition connected by a cross-member 36.

In order to allow passage of the articulated structure 12 from the sitting lowered sitting position—as shown in FIG. 2—to the verticalization or standing position—as illustrated in FIG. 3—each articulated system comprises a maneuvering assembly 40 interposed between the first quadrilateral 17 and the frame 2 and, more particularly, the corresponding hemi-frame 4.

Each maneuvering assembly 40 comprises a first lever 41, articulated on the back part of the frame by means of a pivot 42 and, at the end of a second lever 43 by means of a pivot 44. The other end of the second lever 43 is thus articulated on the first quadrilateral and, according to the example shown, on the bottom sill 19 by means of a pivot 45 and a fixation part 46 attached to the second lever 43.

Each maneuvering assembly comprises also a maneuvering handle 49, which could be made universal to the extent that it must allow the user of the chair to apply a force on said handle, both in terms of the lowered or sitting position shown in FIG. 2 and in terms of the verticalization B shown in FIG. 3 and during the transition or verticalization—lowering movement.

In order to facilitate the verticalization—lowering movement, the body support chair 1 also comprises assistance means 50. According to this example, said assistance means are comprised for each of the articulated systems of a gas jack interposed between the first quadrilateral 13 and the front part of the frame 2.

According to the illustrated example, each gas jack 50 incorporates also automatic blocking means which prevent any movement of the jack and thus of the articulated system to which it is connected, whilst an unblocking control is not applied to the blocking system of the blocking of the jack. The one at least of the handles, preferably the one situated on the side of the user's dominant hand, then has a control member 51 for the blocking means.

Thus, by a joint action on the control member and on the handles, the user can move from a sitting position to a standing position and vice versa.

In order to assure the stability of the user in the standing position, the invention proposes using, as shown more particularly in FIGS. 4 to 7, holding means 60 for the user's legs, arranged at the user's knees or slightly below them. The holding means 60 comprise two cross members 61 which are each fitted on an upright 27 of the foot rest.

Each cross-member 61 is thus attached to the corresponding upright 27, being mobile between a retracted position E—as shown in FIGS. 4 and 5—and a working position T in extension forward—as shown in FIGS. 6 and 7. According to the illustrated example, each cross-member 61 then has an arcuate form, whose concavity in the retracted position is oriented towards the front. Each cross-member has two arms—called the upper 70 and lower 7l, respectively. In order to allow the movement of each cross-member 61, each arm 70 and 71 has an opening 72 and 73 receiving a slug 75, 76 attached to the corresponding upright 27.

Accordingly, it is possible, considering the co-operation of the oblong 73 and/or arcuate openings 72 and the slugs 75, 76, to slide each cross-member 61 between its retracted position E and its working position T. Each cross-member 61 has, in addition, at the distal end 64 of its upper arm 70, latching means 80 for a frontal support element 65 which, according to the illustrated example, is realized in the form of a rigid plate 81 having at each of its ends fastening means 82 such as a recess for engaging on a slug offered by the distal end of the cross-member and forming the latching means 80. Furthermore, the rigid plate 81 is provided on its front face with a shock-absorbing and supporting pad 83. It should be remarked that according to the invention the frontal support element 65 forms a unit assembly which supportingly receives the user's two legs. Obviously, the plate 81 that forms a rigid structural element for taking up the forces applied by the user's two legs could be embodied in another fashion such as in the form of a tubular girder, for example, assuring the rigidity of the element 65.

The means for holding the legs as hereinbefore described are deployed in the following fashion. Then the user wishes to go into the standing position, he moves the cross-members 61 so as to position them in extension T, as illustrated in FIGS. 6 and 7. In said position T, each cross-member then offers a fixation point located at a distance from the uprights 27 for the frontal support element 65, which is engaged by said recesses on the slugs 801 offered by the cross-members 61. The user can then engage his verticalization process.

It should be noted that in order to assure the stability of the cross-members in the extended position, each opening 70 of the lower arms 71 have, preferably but not strictly necessary, one recess 85 for receiving the corresponding slug 75 when a force is practiced towards the front on the support element 65 in the working position T.

It should be noted that the rigid character of the support element 65, 81 as well as of the cross-members 61 makes it possible to perfectly hold the user's legs without applying any lateral stress on his legs.

When the user reassumes his sitting position, it is possible for him to retract the frontal support element and to reposition the cross-members in the retracted position.

In this condition, more particularly illustrated in FIG. 5, the front of the body support chair according to the invention is thus perfectly disengaged and the user is not impaired n his movements by the frontal support means.

The invention claimed is:

1. A body support chair for the physically challenged and disabled, comprising:

a supporting frame and an articulated structure comprising a back, a seat, a foot rest supported by two uprights and means for holding a user's legs, at least in part immovable, said articulated structure forming a verticalizer device allowing passage from a lowered sitting position to a standing position, wherein the means for holding the legs comprises two support beams, each support beam being attached to one of the two uprights of the foot rest and being slidable in a vertical plane between a retracted position and a working position in extension towards the front of the chair at a corresponding distance from the uprights, a front end of each support beam comprising means for affixing an immovable frontal support element extending between the support beams and providing support for the user's two legs, and wherein each support beam has an arcuate form, whose concavity is, in the retracted position, oriented towards the front of the chair and which defines an upper arm and a lower arm, a distal end of the upper arm being provided with the means for affixing immovable frontal support element.

2. A body support chair according to claim 1, wherein the front ends of the support beams are, in the working position, at least each immobilized in a frontal plane relative to the corresponding upright.

3. A body support chair according to claim 1, wherein the upper and lower arms of each support beam each comprise one opening for receiving a slug attached to the corresponding upright for holding and guiding the support beam; the opening of the lower arm being provided at a lower end with a latching recess for receiving in the working position the corresponding guide slug so as to assure a blocking of the movement of the support beam when a force towards the front applied to the distal end of the upper arm.

4. A body support chair according to claim 1, wherein the frontal support element comprises a rigid plate equipped at a rearward part with at least one support pad for the chair user's legs.

5. A body support chair according to claim 1, wherein each of said upper and lower arms has an opening to receive slugs that are disposed on a corresponding upright.

* * * * *